United States Patent [19]

Elzenbeck

[11] 3,979,150

[45] Sept. 7, 1976

[54] CHAIR HAVING A VERTICALLY ADJUSTABLE HEADREST

[75] Inventor: Manfred Elzenbeck, Steinheim, Germany

[73] Assignee: August Froscher K.G., Germany

[22] Filed: Apr. 15, 1975

[21] Appl. No.: 568,275

[30] Foreign Application Priority Data

Apr. 23, 1974 Germany ..... 2419483

[52] U.S. Cl. ..... 297/410

[51] Int. Cl.[2] ..... A47C 1/10

[58] Field of Search ..... 297/391, 397, 410

[56] References Cited

UNITED STATES PATENTS 3,498,672 3/1970 Leichtl ..... 297/397 X

*Primary Examiner*—James C. Mitchell
*Attorney, Agent, or Firm*—Robert E. Burns; Emmanuel J. Lobato; Bruce L. Adams

[57] ABSTRACT

A chair has a backrest and a headrest which is supported by two struts which are longitudinally slidable and also rotatable in apertures of guide members provided in the backrest and in the headrest. The struts have transverse grooves which are engageable by detents in the guide members to hold the struts and hence the headrest in position. The struts are rotatable to disengage the detents from the grooves in the struts. The struts are thus removable both from the backrest and from the headrest. A transverse rod extending between the struts releasably holds them in angular position for engagement of the detents in the grooves.

19 Claims, 3 Drawing Figures

CHAIR HAVING A VERTICALLY ADJUSTABLE HEADREST

FIELD OF THE INVENTION

The present invention relates to a chair having a vertically adjustable headrest attached to the backrest thereof, the headrest being supported by two struts, the struts having engagement grooves operating conjointly with engagement means in at least one guide member for the struts.

BACKGROUND OF THE INVENTION

Chairs of the above described type are known, and are employed, in particular, as motor vehicle seats, in which the headrest primarily serves the safety of the user and only secondarily his comfort.

However chairs with headrests are increasingly being used in the home as well as in executive offices, as they afford the user the possiblity of relaxing as if he were in an easy chair or similar type of chair, while not having to be equipped with correspondingly high, massive backrests, which would result in a chair design which would not be suitable in many cases for reasons of space and/or cost.

Although chairs with headrests provide significant advantages over known easy chairs with high backrests, it has been found that chairs with rigidly attached headrests still do not satisfy all requirements, as it is frequently not desirable for a headrest which is only used occasionally, such as during the lunch period for example, to be seen constantly, and the headrest occasionally is bothersome, as it impedes the view to the rear and, additionally, provides a "relaxed" atmosphere in the office during normal working hours which may be undesirable for psychological reasons in offices which have a high frequency of visitors. Rigidly installed headrests are also bothersome where a plurality of chairs are arranged together for a conference or similar event, with only several of the chairs having headrests, while the others do not have headrests.

SUMMARY OF THE INVENTION

It is the object of the present invention to propose a chair in which the headrest is attached in a simple manner, is vertically adjustable and can be removed. A further object of the present invention is that after removal of the headrest the chair should not differ from a comparable chair in which there is no possibility at all for attaching a headrest and that the comfort of the chair should not be affected by the headrest. In accordance with the present invention, this object is solved in that one guide member, having engagement means, is provided for each of the struts in both the backrest and the headrest. The guide members with their engagement means permit the struts to be able to be connected simply, well and securely with the backrest and headrest, in spite of the easy removability. After the struts have been removed, the chairs do not differ from chairs of the usual design. Vertical adjustment and removable engagement can be designed with similar, or even the same, guide members and engagement means. Since the struts can not only be withdrawn from the backrest, but from the headrest as well, the headrest is easy to pack and store, as there are not bothersome struts extending therefrom.

If both of the guide members in the headrest and in the backrest are combined to one guide block each with two guide apertures, with at least one springloaded engagement member extending into each of the guide apertures, fabrication is simplified and, in particular, good alignment of the guide apertures is ensured without the danger of installation inaccuracies, so that insertion, vertical adjustment and withdrawal do not pose any difficulties.

If the engagement means are designed so as to comprise cylindrical engagement pins arranged at right angles to the longitudinal axis of the struts, this permits a flat design with good spring and engagement means, on the one hand, while ensuring with simple means, on the other hand, that the engagement means do not protrude too deeply into the guide apertures, thereby permitting the struts to be inserted well. A development in which both ends of the engagement pins are pretensioned in the direction of the guide apertures to which they are associated by means of compression springs ensures good movability and engagement and permits sufficiently dimensioned springs, having favourable elasticity, to be provided.

If the struts are designed in such a manner that at least that portion of the struts which extends into the guide apertures is rotatable after being disengaged and if the struts are preferably designed in a cylindrical manner, it is not necessary to provide any further releasing members for the engagement means, as the struts can be rotated, thereby releasing the engagement, when it is necessary to remove the headrest.

If the struts are designed in such a manner that a section of the struts facing the headrest is angled in the direction of the seat area relative to that section of the struts facing the backrest, when the headrest is adjusted upwardly it moves somewhat forwardly relative to the backrest, thereby increasing the comfort of the chair and permitting the headrest to be better adapted to the various sitting positions and body sizes. If the struts are additionally rotatable, the headrest need only be pressed downward on one side to release the engagement. This then results in a parallelogram-like swivel motion, which causes the struts to rotate and the engagement pins to be pressed out of the grooves.

In order to prevent a rotary movement and disengagement of this type from occurring inadvertently, it is possible for both of the struts to be connected one with the other by anti-twisting means extending at right angles to the longitudinal axis of the struts, which can advantageously be designed in such a manner that the anti-twisting means comprise an anti-twisting rod which engages lateral holes in the struts, the anti-twisting rod can be screwed into at least one of the lateral holes, and the anti-twisting rod can engage at least one of the lateral holes, while simultaneously being able to serve as a lever for causing a rotary motion of the struts in order to release the struts. The anti-twisting rod is secured against loss by screwing or engagement. However it can also be secured by means of a press fit through insertion in appropriate holes.

In further advantageous developments of the invention, a plurality of engagement grooves, associated to various elevations and requiring only a minimum of disengagement force, can preferably be provided on those sections of the struts facing the headrest; at least one engagement groove can be provided on that section of the struts facing the backrest, with the configuration of the engagement groove being selected in such a manner as to result in a greater engagement effect for longitudinal stresses being placed on the struts than between the engagement grooves in that section of the struts facing the headrest and the engagement means associated thereto; and that engagement groove in the section of the struts facing the headrest which is effective in the uppermost position of the headrest can be asymmetrically designed in such a manner as to at least impede withdrawal of the headrest in order to ensure good engagement in the desired position, on the one hand, and to prevent inadvertent withdrawal on the other. If each of the two ends of the struts has a guide surface which is bevelled toward the end, the struts can be inserted simply when needed. The arrangement of the guide openings beneath openings in the seam in the upholstery eliminates the need for disturbing special inlet openings in the upholstery which require a great deal of work, on the one hand, while making the chair attractive with the headrest both in place and removed, on the other.

BRIEF DESCRIPTION OF THE DRAWINGS

The objects, characteristics and advantages of the invention will be more fully understood from the following description in conjunction with the accompanying drawings, in which.

DETAILED DESCRIPTION OF THE DRAWINGS

Figure 1:
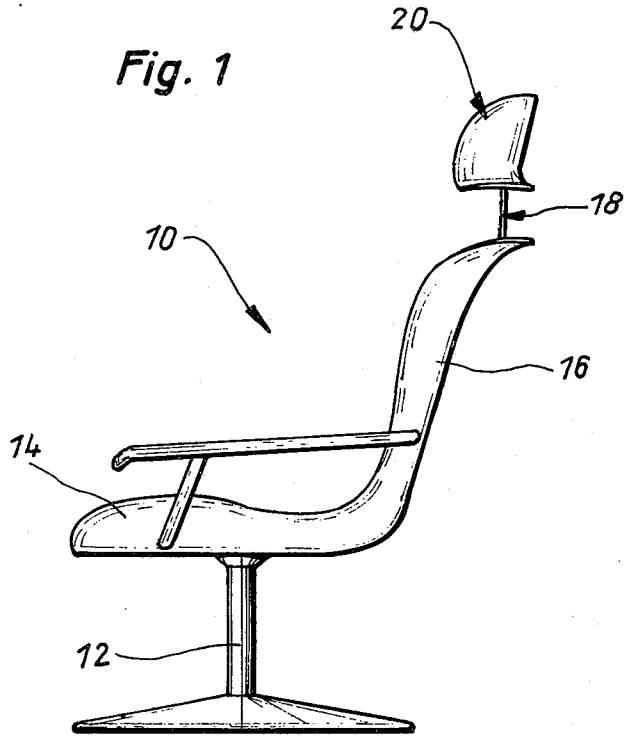
FIG. 1 is a side view of a chair according to the present invention.

As can be seen from FIG. 1, the chair 10 has a base 12, in the form of a rotary base for example, a seat area 14, a backrest 16 and a headrest 20 attached thereto by means of struts 18.

Figure 2:
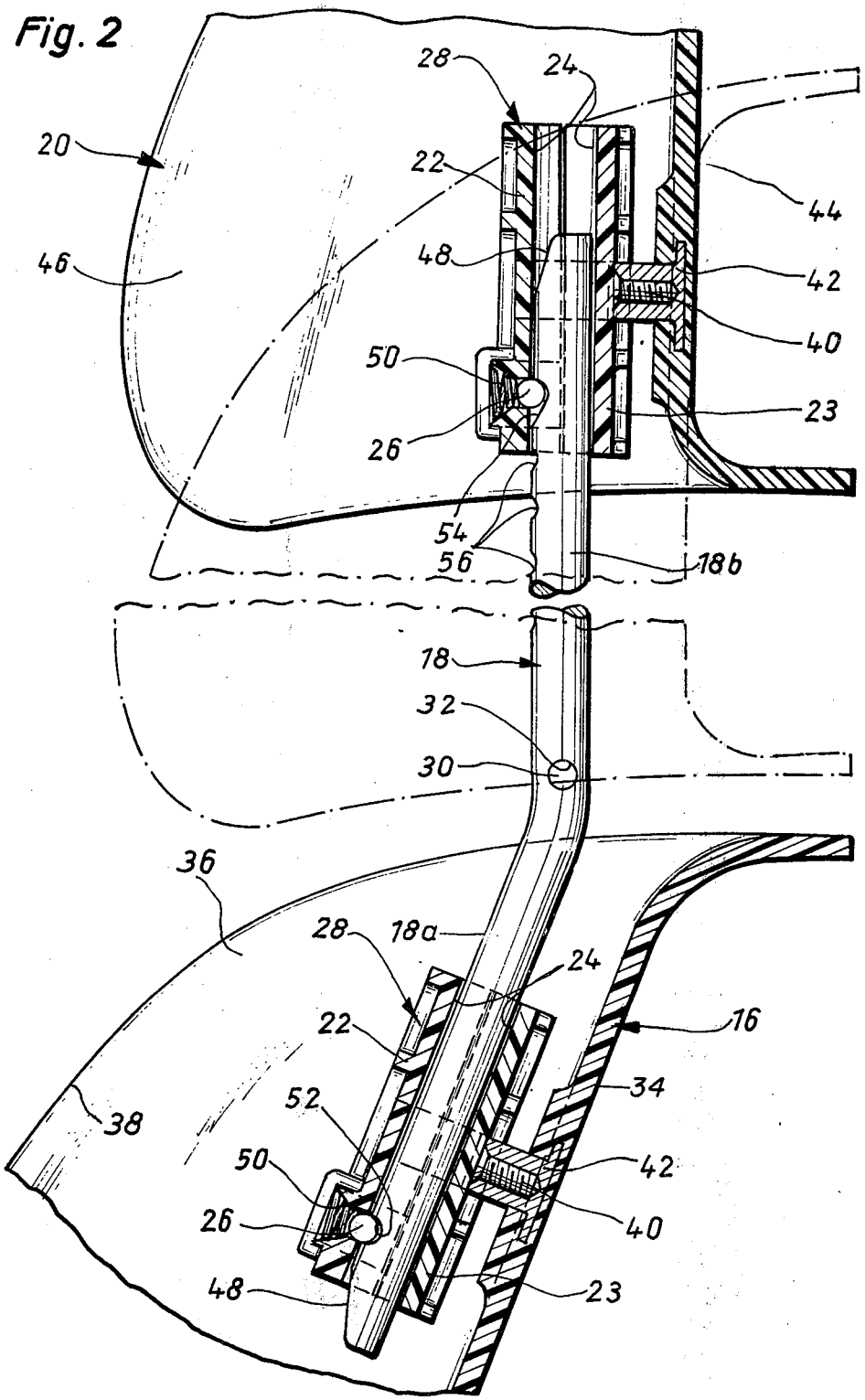
FIG. 2 is an enlarged detail of a section through the chair shown in FIG. 1, taken in the area of the upper end of the backrest and in the area of the headrest.

As can be seen in FIG. 2, struts 18, fabricated of round stock, are angled in such a manner as to produce a lower section 18*a* extending parallel to backrest 16, which is inclined rearwardly relative to the vertical position, and an upper section 18*b* extending generally vertically and supporting headrest 20 in the practical example shown herein.

Figure 3:
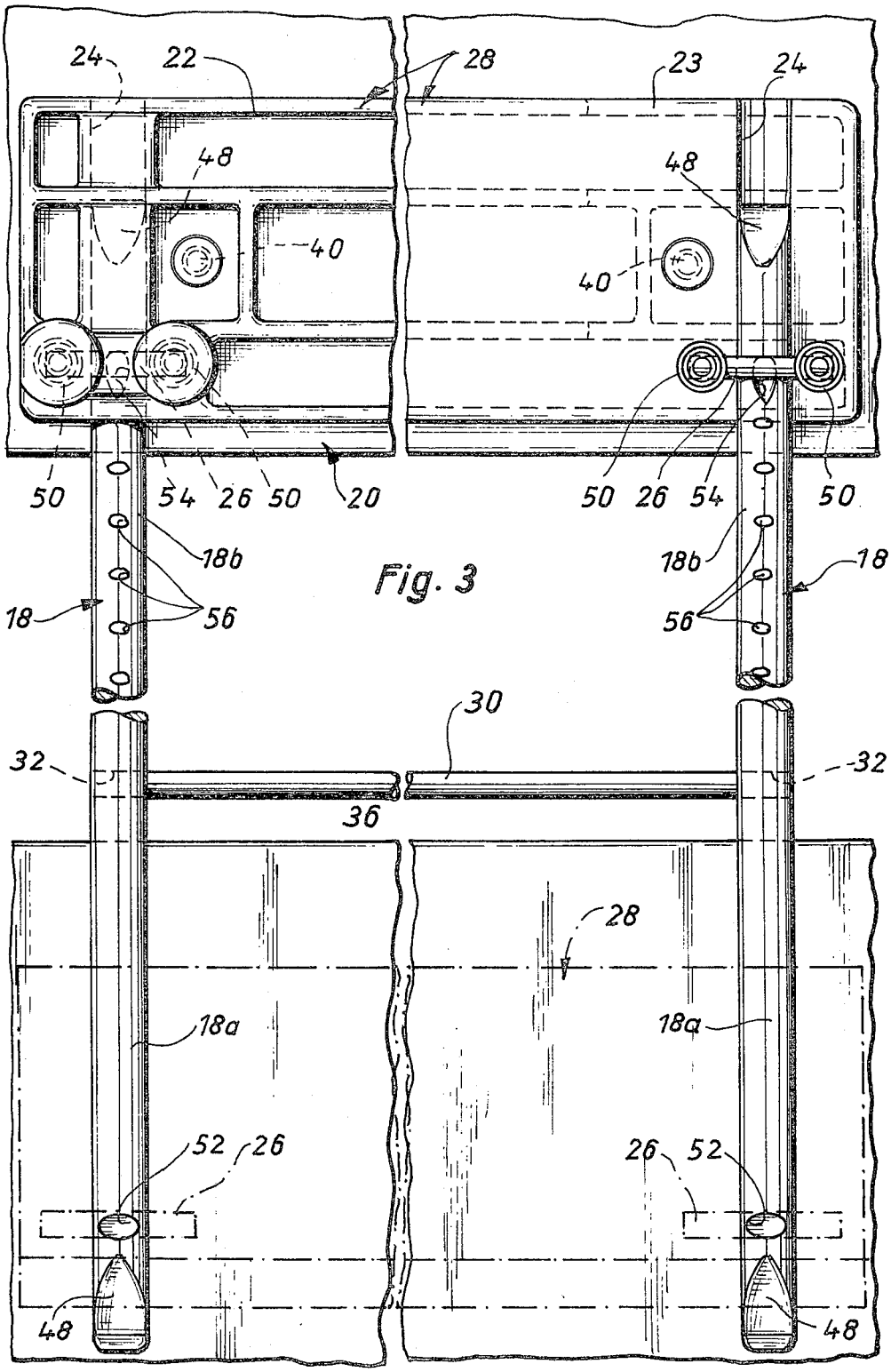
FIG. 3 is a front view of the fixing means for the headrest.

One guide member 22 for each of the struts is provided in both backrest 16 and headrest 20; said guide member 22 has a guide aperture 24, with a spring-loaded engagement element in the form of a cylindrical engagement pin 26 extending into each of said guide openings. In both backrest 16 and headrest 20, each of guide members 22 are combined to form a guide block 28, as can be seen especially clearly in FIG. 3. To prevent undesired twisting, the two struts 18 are connected one with the other by means of an anti-twisting rod 30, which engages lateral holes 32 in struts 18. In the illustrated practical example, the anti-twisting rod is arranged directly above backrest 16 so as not to influence the positioning of headrest 20.

As shown in FIG. 2, in the illustrated practical example backrest 16 has a backrest shell 34 which can be of wood or plastic, for example, and is designed entirely in accordance with the shape of the human body and has slight side walls 36 with contour line 38.

Backrest shell 34 has unillustrated upholstery. In fabricating the chair, a guide block 28 is connected to backrest shell 34, in particular by means of screws 40 which engage threaded sockets 42 on backrest shell 34. Backrest 16 is then upholstered in the usual manner, whereby the upholstery can extend over the edge of backrest shell 34 and be attached thereto with a plastic section. The upholstery is seamed in such a manner that one seam extends over the locations in which the struts egress from the upholstery. The seam can then be interrupted briefly directly above each guide opening in order to permit struts 18 to be inserted. This design of the upholstery provides the advantage that it is not at first possible to see that the finished chair is prepared for the attachement of a headrest. A chair of this type can therefore be readily arranged in a conference room with other similar chairs to which no headrests have been attached, for example.

Headrest 20 also comprises a rigid shell 44, to which a guide block 28 is attached by means of screws 40, as well as upholstery which is attached to shell 44 and covers guide block 28. A seam with interruptions can also be provided on headrest 20, through which struts 18 can be inserted.

The headrest can now be installed in such a manner, for example, that sections 18*a* of struts 18 are first inserted into those guide blocks 28 which are connected with backrest 16. During this operation, the lower end of section 18*a* of each strut 18 comes into a contacting relationship with spring-loaded engagement pin 26 in guide aperture 24. The lower end of strut 18 has a bevelled guide surface 48, which simplifies introduction of strut 18 on the one hand while on the other hand ensuring that the angle of alignment between strut 18 and guide aperture 24 is such that engagement pin 26, whose two ends are pressed in the direction of the longitudinal axis of guide aperture 24 by compression springs 50, can engage an engagement groove 52 located after guide surface 48 in lower section 18*a* of strut 18. As can be clearly seen from FIG. 2, said engagement groove 52 is designed in such a manner as to provide a significant resistance against the further insertion of strut 18; under normal circumstances, this resistance is not overcome. Moreover, engagement groove 52 is so deep that, after engagement pin 26 engages, strut 18 can normally also not be withdrawn upwardly without being previously rotated in order to eliminate the locked condition between engagement groove 52 and engagement pin 26.

After both engagement pins 26 in lower guide block 28 have engaged and, as described above, are thus connected virtually rigidly with backrest 16, headrest 20 can be inserted onto the upper ends of struts 18. The ends of upper sections 18*b* of struts 18 also have guide surfaces 48 which force back engagement pins 26 in guide apertures 24 of upper guide block 28 so far that struts 18 can be pushed in to an uppermost engagement groove 54, which corresponding engagement pins 26 engage. The depth of uppermost engagement groove 54 increases from bottom to top, so that after engagement pins 26 engage, headrest 20 can no longer be withdrawn upwardly with normal force. However it is possible, on the other hand, to push headrest 20 further downward, where additional engagement grooves 56 are provided along upper sections 18*b* of struts 18; additional engagement grooves 56 serve to secure headrest 20 at various heights in such a manner that it is adjustable. Additional engagement grooves 56 are flat enough for headrest 20 to easily be able to be set at the desired height, while on the other hand being deep enough to prevent undesired slipping of headrest 20 if employed in accordance with its intended use.

The above shows clearly that anti-twisting rod 30 can be inserted into lateral holes 32 in struts 18 at any desired time during installation of headrest 20. If, on the other hand, headrest 20 is to be removed, it is first necessary to remove anti-twisting rod 30 from its engagement with at least one of lateral holes 32. Struts 18 must be rotated in order to now eliminate the locked condition between struts 18 and engagement pins 26. This can be performed, on the one hand, by means of anti-twisting rod 30. However because of the angled design of struts 18, the engagement can be eliminated much more easily in the embodiment according to the present invention by pressing against one side of headrest 20. Since both sections of struts 18 are guided parallel in guide apertures 24 in the guide blocks, pressing down one side of headrest 20 swivels the struts, thereby rotating them in their respective guide apertures, which causes engagement pins 26 to be pressed out of the engagement grooves, whereupon struts 18 can then be withdrawn from backrest 16 and/or headrest 20, so that chair 10 again looks like a completely normal chair, without a headrest.

Although especially advantageous results are achieved through the combination of the various design features realized in the above-described practical example, it is obvious that numerous details can be modified within the scope of the basic concept of the invention. Thus, for example, it is possible to provide the guide apertures in individually assembled guide members and to mount said guide members or lower and/or upper guide block 28 on the outside of backrest shell 34 and/or rigid shell 44 of headrest 20; in this case guide blocks 28, which are generally of plastic, would only have to be appropriately rounded in order to avoid the danger of injuries. Attachment of the guide blocks to the outside of the rigid shells is especially advantageous wherever there is either no upholstery at all or only thin upholstery, or where existing chairs are to be subsequently modified in such a manner as to permit the attachment of a headrest. Moreover, the engagement means need not necessarily be engagement pins, although engagement pins have proven their usefulness in actual practice. It is possible, for example, to employ pawl-like engagement means which, with appropriately designed engagement grooves, would also permit the struts to be inserted into the guide apertures while nevertheless preventing struts 18 from being withdrawn without being previously rotated. If it is not desired that the rotary motion of the struts for disengaging them from the backrest simultaneously results in their disengagement from the headrest, the engagement grooves in the upper section of the struts can be provided on a larger portion of the circumference thereof, thereby necessitating additional rotation of the struts in order to eliminate the engagement of the headrest therewith. Finally, headrests which can be swivelled relative to the struts can also be employed with the chair according to the present invention. However this is generally not required, as angling the struts ensures that the headrest assumes the proper attitude relative to the backrest in every height at which it is set.

As can be clearly seen from the above description, stock having a circular cross section will normally be employed for struts, as is also shown in the drawing, and engagement grooves having cylindrical surfaces will generally be employed. However the invention can also be realized with struts having an elliptical cross section or with struts having any other non-circular cross section. Struts having a D-shaped cross section, with the engagement grooves on the flattened section, would be favourable, for example. However the decisive factor for the advantageous development of the invention is that the struts can be rotated in their guides for disengagement.

What I claim and desire to secure by Letters Patent is:

1. In a chair having a backrest and a vertically adjustable and removable headrest, means for adjustably and removably mounting said headrest on said backrest comprising two parallel struts extending downwardly from said headrest, guide means on said backrest having guide apertures receiving said struts, said struts being longitudinally slidable and also rotatable in said guide apertures and having on one side of a lower portion of each strut a transverse groove, said guide means comprising spring pressed detents engageable in said grooves in said struts when said struts are in one angular position and disengaged from said grooves when said struts are in another angular position, whereby said detents are disengageable from said grooves by rotation of said struts for longitudinal movement of said struts in said guide members for removal of said headrest from said backrest.

2. A chair according to claim 1, in which said struts are of circular cross section for rotation of said struts in said guide apertures of said guide means.

3. A chair according to claim 1, comprising guide means in said headrest having guide apertures for receiving said struts, said struts being longitudinally slidable and rotatable in said apertures and having on one side of an upper portion of each strut a transverse groove, said guide means of said headrest comprising spring pressed detents engageable in said grooves of said struts when said struts are in one angular position and disengaged from said grooves when said struts are in another angular position, whereby said detents are disengageable from said grooves by rotation of said struts for longitudinal movement of said struts in said guide means for removal of said struts from said headrest.

4. A chair according to claim 3, in which upper portions of said struts have a plurality of spaced transverse grooves for engagement by said detents to position said headrest selectively in a plurality of positions relative to said backrest.

5. A chair according to claim 4, in which the uppermost groove in each strut is deeper than other grooves in the upper portions of said struts and is asymmetrical with a downwardly sloping side whereby said detent can slide downwardly more easily from said groove than upwardly.

6. A chair according to claim 5, in which said groove in the lower portion of each strut is deeper than the grooves in the upper portion thereof except the uppermost groove.

7. A chair according to claim 4, in which said struts are bent in a midportion thereof so that the upper portion of each strut is inclined forwardly with respect to said backrest whereby said headrest when adjusted upwardly on said strut is moved forwardly relative to said backrest.

8. A chair according to claim 3, in which said groove in the upper portion of each strut is of greater circumferential extent than said groove in the lower portion thereof, whereby said strut must be turned through a greater angle to disengage said detent from said groove in the upper portion of the strut than said groove in the lower portion thereof.

9. A chair according to claim 1, comprising means for releasably retaining said struts angularly in position for engagement of said detents in said grooves.

10. A chair according to claim 9, in which said retaining means comprises a rod engaged in transverse apertures in midportion of said struts.

11. A chair according to claim 10, in which said rod extends through a transverse aperture in one strut and is screwed into a threaded aperture in the other strut.

12. A chair according to claim 1, in which said guide means comprises a unitary guide block having apertures for both of said struts.

13. A chair according to claim 1, in which said detents comprise cylindrical pins extending transversely of said struts.

14. A chair according to claim 13, comprising two springs at opposite ends of each of said pins pressing said pins toward said struts.

15. In a chair having a backrest and a vertically adjustable and removable headrest, means for adjustably and removably mounting said headrest on said backrest comprising first guide means in said headrest having laterally spaced guide apertures receiving upper portions of two parallel struts extending downwardly from said headrest, said struts being longitudinally slidable in said guide apertures and having on one side of an upper portion of each strut a plurality of spaced depressions, said first guide means comprising spring pressed detents engageable selectively in said depressions to position said headrest selectively relative to said struts and second guide means in said backrest having laterally spaced guide apertures for receiving lower portions of said struts, said struts being insertable in said guide apertures and having a depression on one side of a lower portion of each strut, said second guide means comprising spring pressed detents engageable in said depressions in said lower portions of said struts releasably to retain said struts in said guide apertures of said second guide means, whereby said headrest is vertically adjustable on upper portions of said struts and said headrest is removable from said backrest and said struts are removable from said backrest and from said headrest.

16. A chair according to claim 15, in which said struts are bent in a midportion thereof so that upper portions of said struts are inclined forwardly relative to said backrest, whereby said headrest when moved upwardly on said struts is moved forwardly relative to said backrest.

17. A chair according to claim 15, in which said struts are rotatable in said guide apertures to disengage said detents from said depressions and thereby permit longitudinal movement of said struts in said guide apertures.

18. A chair according to claim 17, comprising means for releasably retaining said struts angularly in position for engagement of said detents in said depressions.

19. A chair according to claim 15, in which depressions in upper portions of said struts are shallower than said depressions in lower portions of said struts, whereby said headrest is adjustable vertically on said struts while said struts are retained in said guide apertures of said guide means in said backrest.

* * * * *